United States Patent [19]

Leone et al.

[11] Patent Number: 5,025,895

[45] Date of Patent: Jun. 25, 1991

[54] ELEVATOR CAR TOP INTRUSION DEVICE

[75] Inventors: Richard J. Leone; Robert F. Cummins, both of Yonkers; Joseph Vitiello, Riverdale; Thomas Brochhagan, No. Bellmore, all of N.Y.

[73] Assignee: G.E.C. Holding Corp., Bronx, N.Y.

[21] Appl. No.: 462,593

[22] Filed: Jan. 9, 1990

[51] Int. Cl.[5] ..... B66B 5/00

[52] U.S. Cl. ..... 187/105; 340/555; 361/173; 361/179

[58] Field of Search ..... 340/555, 556, 567, 552; 187/105, 140; 361/179, 173

[56] References Cited

U.S. PATENT DOCUMENTS 3,641,549 2/1972 Misek et al. .
3,745,550 7/1973 Anthony et al. .
4,052,716 10/1977 Mortensen .
4,067,416 1/1978 Lowry .
4,266,124 5/1981 Weber et al. ..... 340/556
4,733,081 3/1988 Mizukami .
4,879,461 11/1989 Philipp .

*Primary Examiner*—A. D. Pellinen
*Assistant Examiner*—Charles E. Eckholdt
*Attorney, Agent, or Firm*—Weil, Gotshal & Manges

[57] ABSTRACT

There is provided a detection system for detecting attempted entry onto the shaft-side roof of an elevator cab which includes a power supply for supplying power to the system, a proximity detector in electrical connection with the power supply which is disposed proximate the roof of the cab for detecting an object entering a zone of detection including the top of the cab, the detector in a preferred embodiment including an optical source for generating a detection beam and a corresponding optical receiver for receiving the detection beam when it is diffused by an object entering the detection zone and for providing a detection signal when the object enters the detection zone, and detection indicator responsive to the detection signal for indicating an attempted entry.

24 Claims, 2 Drawing Sheets

ELEVATOR CAR TOP INTRUSION DEVICE

This invention relates to intelligent elevator control systems and in particular to a shaft-side roof intrusion detector for such systems

BACKGROUND OF THE INVENTION

As currently designed, intelligent elevator systems incorporate built-in safety precautions to ensure that no injury will be inflicted upon users during the normal operation of the elevator. Such devices include pressure-sensitive elements to determine pressure put on a door while it is closing, optical elements to determine when someone has passed through the elevator doorway, speed tolerance governing and braking devices and the like. Recently, particularly in urban areas having many high-rise structures, people have gained access to the shaft-side roof of the elevator cab through artful and wrongful manipulation of the elevator system. One common form of unauthorized access to elevator car tops is through the placement of strings on the roller release assembly of the elevator door interlock when the elevator is servicing a floor. Once the string is attached to the interlock release assembly, the elevator doors close normally, and the elevator is sent to the next lower floor. When the elevator arrives at the next lower floor, the shoe string is pulled on the floor above allowing the exterior hoistway door to open, which in turn allows access to the top of the elevator car.

While some access to the roof of the elevator car is necessary for the performance of maintenance and repairs on the system, unauthorized entry is extremely dangerous and can easily result in severe injury or death. Thus, a need exists for a device which can detect an unauthorized intrusion and initiate a proper response upon detection. Because of the special nature of the operating environment of an elevator shaft, there exists several problems not readily ascertainable or solvable by the use of a wide variety of detection techniques. For example, the constant vibration of the elevator cab within the shaft would cause severe problems for a reflective optical system because of the misalignment created between source and reflector by the vibrations. Similarly, false detections can easily be made because of the effect on a beam caused by the high volume of dust and particles present in the shaft space. Pressure sensitive detectors are also not a viable alternative because of the extreme pressure changes which occur in the shaft as the elevator cab moves within it. Further, these systems do not lend themselves to servicing nor do they permit the elevator system to return to normal operation when an intruding object is removed. A need exists, therefore, for a reliable detection device which can be easily installed and maintained, and which can accurately detect the entry onto an elevator cab roof without giving false warnings.

It is an object of the present invention to provide a reliable intrusion detection system for use on the shaft-side roof of an elevator cab.

It is a further object of the present invention to provide an intrusion detection system for use on the shaft-side roof of an elevator cab which can detect an unauthorized entry onto the roof and produce an appropriate response.

It is a further object of the present invention to provide an intrusion detection system for use on the shaft-side roof of an elevator cab which will not produce false indications of an intrusion based on the operating environment of the elevator shaft and which will allow the elevator system to be easily serviced and will allow it to return to normal operation if an object intrudes upon the cab roof and is immediately thereafter removed from the cab roof.

It is a still further object of this invention to employ a proximity detection system in conjunction with a switching network to detect unauthorized entry onto a elevator cab roof on the shaft-side of the cab.

SUMMARY OF THE INVENTION

These and other objects of the invention are achieved in accordance with the present invention by the use of proximity detection means including an optical beam source for generating a detection beam within a zone of detection including the elevator shaft-side roof and corresponding optical receiver means for receiving the diffused detection beam when it is diffused from an object entering the detection zone and thereafter generating a detection signal, power supply means and switching network means for applying power from the power supply means to the proximity detection means and being responsive to the detection signal for applying power from the power supply means to detection indication means. In a preferred embodiment of the invention, the detection signal is latched for a period of time and also sent to an external elevator safety system and also operates to energize an audible siren.

DETAILED DESCRIPTION OF THE PREFERRED EMBODIMENT

Figure 1:
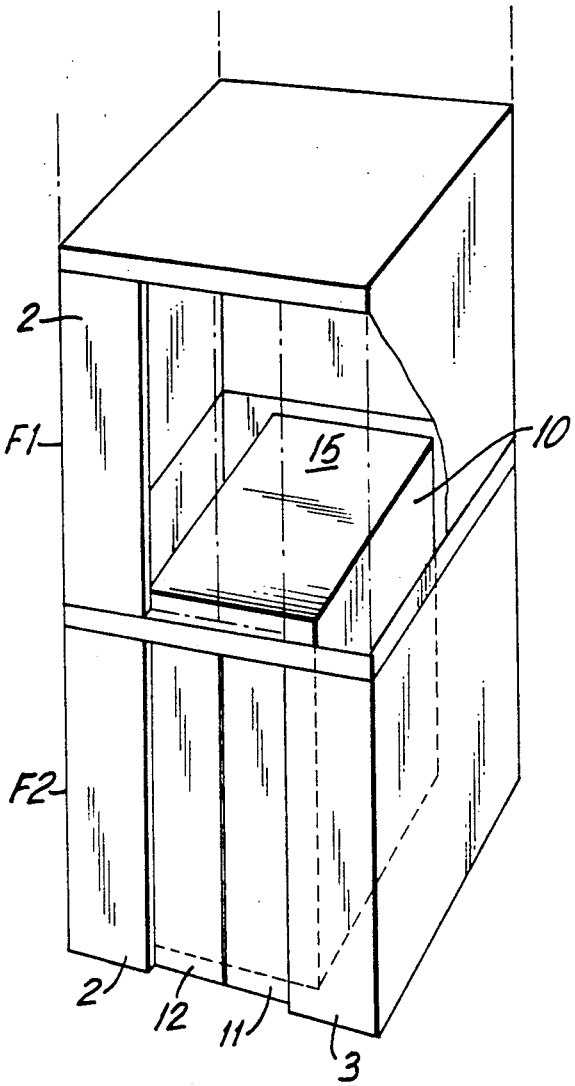
FIG. 1 is pictorial representation showing two floors of an elevator system.

In FIG. 1, an elevator shaft 1 is shown in section along two floors F1 and F2. Each floor has a set of hoistway doors 2, 3 which block entry to the elevator shaft when the elevator car is not servicing that floor and allow entry to the car when it is servicing the floor. In FIG. 1, the elevator car 10 is shown in phantom line servicing floor F2. The elevator car doors 11, 12 are shown closed on floor F2. On floor F1, the hoistway door 2 is retracted and door 3 is not shown. As shown, when the hoistway doors 2, 3 on floor F1 are manipulated to remain open when the elevator is servicing floor F2, the shaft-side roof 15 of elevator car 10 is visible and accessible from floor F1 through the shaft opening created by the retracted hoistway doors 2, 3 on floor F1.

Figure 2:
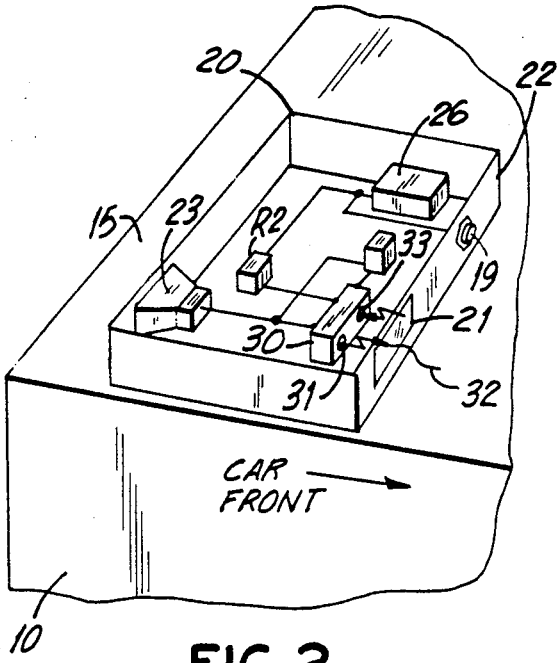
FIG. 2 is a pictorial representation showing the present invention disposed in a housing and mounted on the shaft-side roof of an elevator car.

FIG. 2 is a pictorial representation of the present invention disposed in a housing 20 mounted on the shaft-side roof 15 of elevator car 10. The arrangement of FIG. 2 is shown schematically in FIG. 3.

A proximity detection unit 30 is mounted in the housing such that it aligns with a beam aperture 21 formed in a lateral side 22 of the housing 20. Proximity detection unit 30 contains a modulated light emitting diode 31 which generates a detection beam 32 inside the elevator shaft proximate the location of the elevator car roof 15. Proximity detection unit 30 also includes a photodetector cell 33 designed to receive and detect a diffusion of the beam 32 if and when an object enters the path of the emitted detection beam 32. A commercially available and acceptable device for unit 30 is an Allen Bradley Type 42MR Photodetector.

Figure 3:
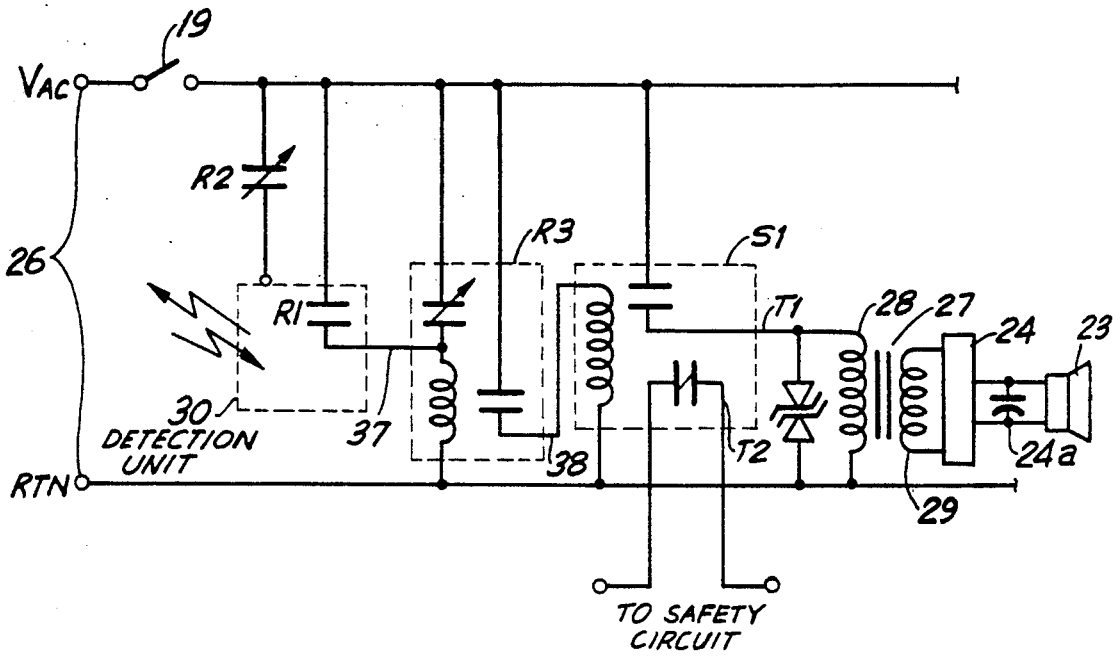
FIG. 3 is a schematic representation of the system of FIG. 2 with no power applied.

As shown in FIG. 3, the proximity detection unit 30 receives primary power from a power supply unit 26 and is electrically connected to an in-line delay-on-make timer relay R2. The power supply unit can be replaced by tapping the main line of the elevator system. The proximity detection unit 30 has an internal switching system R1 which is described in greater detail hereinbelow.

Figure 2A:
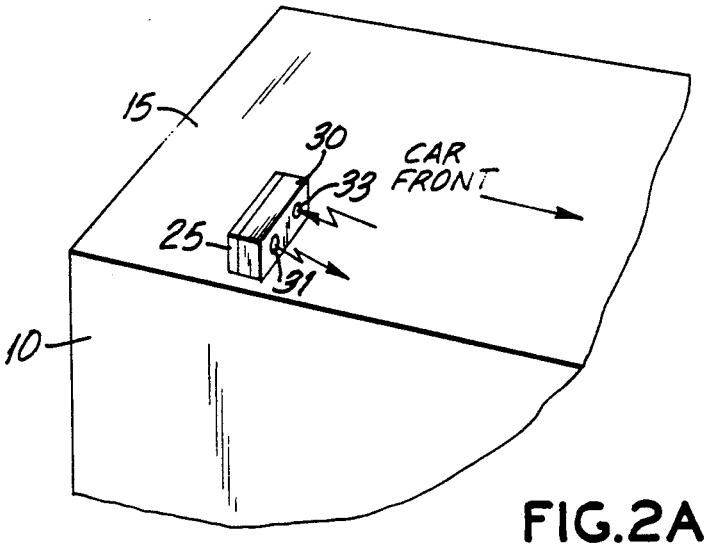
FIG. 2A is an alternative embodiment of the present invention.

The output 37 of internal system R1 is in turn in electrical connection with an in-line delay-on-break timer relay R3 which acts to latch a signal presented at its input by relay R1. The output 38 of relay R3 is electrically connected to a four-pole switching network S1. One side of the primary tap 28 of step-down transformer 27 is electrically tied to the switch S1 at terminal T1. Switch S1 also has a pair of normally closed contacts T2 electrically connected in series with other safety devices and ultimately to an external elevator safety circuit. Typically, transformer 27 will step down the available 110 V-AC line to 12 volts. The secondary tap 29 of transformer 27 drives an audible warning indicator siren 23 across a rectifier circuit 24 and filter capacitor 24*a*. It will be appreciated by those of ordinary skill in the art that relays R2 and R3, switching network S1 and the associated control signals produced in accordance with the delay-on-make and delay-on-break functions can be replaced by an electronic circuit including, respectively, appropriate power MOSFET's (metal oxide semiconductor field effect transistors) or bipolar transistors, an appropriate power transistor amplifier to drive the audible warning indicator, and appropriate control circuitry. In this case, the housing 20 may be replaced by a printed circuit board 25 as shown in FIG. 2*a*.

Figure 4:
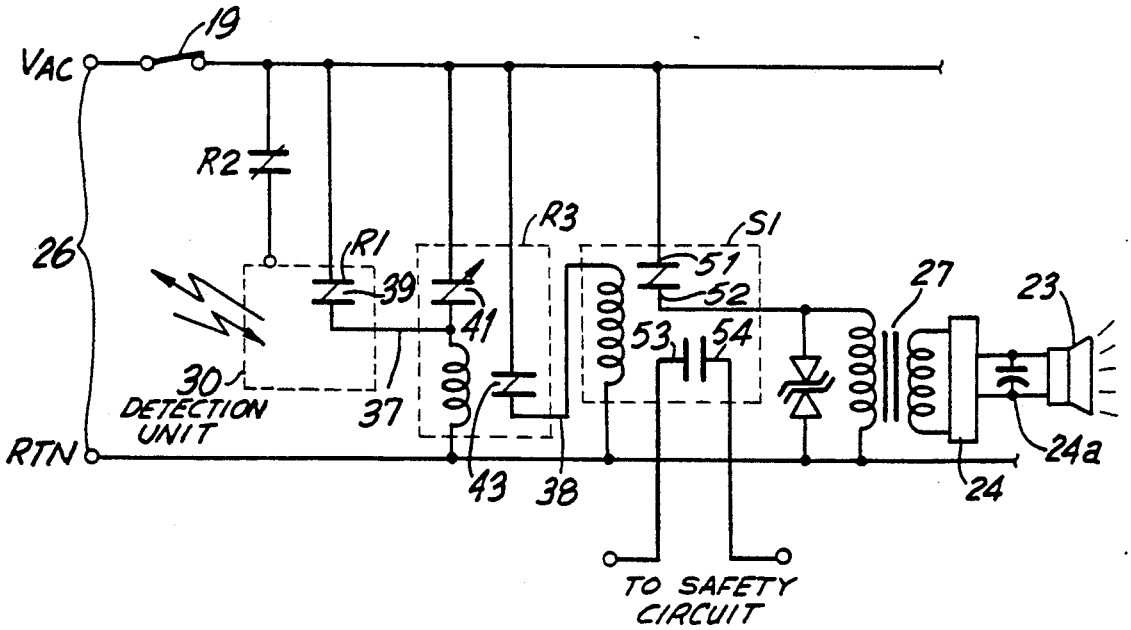
FIG. 4 is a schematic representation of the system of FIG. 2 with power applied.

The schematic diagram shown in FIG. 3 represents a condition in which no power has yet been applied to the system. With reference to FIG. 4 the operation of the present invention is described when it is armed and an object, such as a person, has entered upon the shaft-side roof of the elevator cab. The system is initially armed by turning key-switch 19 to the on position. In-line delay-on-make timer relay R2 closes its contacts a certain elapsed time after key-switch 19 is turned to the position. This allows the operator sufficient time to arm the system and exit the elevator cab roof without setting off the alarm. Power is supplied through timer relay R2 to the photohead circuit of detection unit 30. When photohead 33 detects the diffusion of beam 32 from the object in the detection zone, contacts 39 of internal, switching system R1 are closed, thereby energizing the coil of latching relay R3. The operation of latching relay R3 is such that even if the object leaves the detection zone, thereby opening relay contacts 39, the delay-on-break function will keep contacts 41 of relay R3 closed for a predetermined amount of time. This has the effect of keeping the coil of relay R3 energized and the detection signal latched at relay R3 for a predetermined amount of time. Once relay R3 is energized, the contacts 43 will close to provide power to and energize the coil of switch S1, which has normally open contacts 51 and 52 and normally closed contacts 53 and 54. The normally open contacts 51 and 52 close upon energization of the switch coil and act to supply power to transformer 27, thereby activating siren 23. Normally closed contacts 53 and 54 are connected in series with other safety devices of the elevator safety circuit. Upon energization of the switch coil, contacts 53 and 54 create an open circuit in the safety circuit which causes the elevator to cease operation and carry out functions in accordance with the predetermined algorithmic scheme of the safety circuit. If the object leaves the detection zone, as stated above, the siren 23 will produce a warning signal for a period of time equal to the latching period of relay R3 and, thereafter, control of the elevator will return to the normal operating system. If the object remains in the detection zone, the audible warning signal and open safety circuit will be continuously produced. Alternatively, the system may be designed to discontinue elevator service when an object has entered and subsequently been removed from the roof of the elevator car by always keeping the safety circuit open. This may be accomplished by simply omitting the in-series connection of normally closed terminals 53 and 54 of switch S1 and replacing it with a switching mechanism which is adapted to open and remain open each and every time an intrusion is detected.

The detailed description of the preferred embodiment having been set forth herein, it is known that there can be departure therefrom without departing from the true scope and spirit of the invention as claimed herein.

We claim:

1. A detection system for detecting attempted entry onto the shaft-side roof of an elevator cab comprising: power supply means for supplying power to said system; proximity detection means in electrical connection with said power supply means and being disposed proximate said roof for detecting an object entering a zone of detection including the top of said cab comprising optical source means for generating a detection beam and corresponding optical receiver means for receiving said detection beam when it is diffused by an object entering said detection zone and for providing a detection signal when said object enters said detection zone; and detection indicating means responsive to said detection signal for indicating said attempted entry.

2. The detection system according to claim 1 further comprising signal latching means for latching said detection signal provided by said proximity detection means, said detection indication means being responsive to said latched detection signal.

3. The detection system according to claim 2 wherein said signal latching means includes time-variable means for varying the period during which said detection signal is latched.

4. The detection system according to claim 1, 2, or 3 wherein said optical source means comprises an output from a modulated light emitting diode.

5. The detection system according to claim 4 further comprising a switch for applying power from said power supply means to said system and relay means being energized in response to said detection signal for activating aid detection indication means.

6. The detection system according to claim 5 wherein the detection indication means comprises an audible siren.

7. The detection system according to claim 5 wherein the detection indication means comprises an optical indicator.

8. The detection system according to claim 5 wherein the detection indication means includes means for transmitting a detection indication signal to an external elevator safety system.

9. A detection system for detecting attempted entry onto the shaft-side roof of an elevator cab comprising: power supply means for supplying power to said system; proximity detection means in electrical connection with said power supply means and being disposed proximate said roof for detecting an object entering a zone of detection including the top of said cab comprising optical source means for generating a detection beam and corresponding optical receiver means for receiving said detection beam and for providing a detection signal when said object enters said detection zone; and detection indicating means responsive to said detection signal for indicating said attempted entry.

10. The detection system according to claim 9 further comprising signal latching means for latching said detection signal provided by said proximity detection means, said detection indication means being responsive to said latched detection signal.

11. The detection system according to claim 10 wherein said signal latching means includes time-variable means for varying the period during which said detection signal is latched.

12. The detection system according to claim 9, 10, or 11 wherein said optical source means comprises an output from a modulated light emitting diode.

13. The detection system according to claim 4 further comprising a switch for applying power from said power supply means to said system and relay means being energized in response to said detection signal for activating said detection indication means.

14. The detection system according to claim 13 wherein the detection indication means comprises an audible siren.

15. The detection system according to claim 13 wherein the detection indication means comprises an optical indicator.

16. The detection system according to claim 13 wherein the detection indication means includes means for transmitting a detection indication signal to an external elevator safety system.

17. A detection system for detecting attempted entry onto the shaft-side roof of an elevator cab comprising: power supply means for supplying power to said system; proximity detection means in electrical connection with said power supply means and being disposed proximate said roof for detecting an object entering a zone of detection including the top of said cab comprising optical source means for generating a detection beam and corresponding optical receiver means for continually receiving said detection beam as said beam is diffused by an object in the elevator shaft and for providing a detection signal when said detection beam is no longer being received; and detection indicating means responsive to said detection signal for indicating said attempted entry.

18. The detection system according to claim 17 further comprising signal latching means for latching said detection signal provided by said proximity detection means, said detection indication means being responsive to said latched detection signal.

19. The detection system according to claim 18 wherein said signal latching means includes time-variable means for varying the period during which said detection signal is latched.

20. The detection system according to claim 17, 18, or 19 wherein said optical source means comprises an output from a modulated light emitting diode.

21. The detection system according to claim 20 further comprising a switch for applying power from said power supply means to said system and relay means being energized in response to said detection signal for activating said detection indication means.

22. The detection system according to claim 21 wherein the detection indication means comprises an audible siren.

23. The detection system according to claim 21 wherein the detection indication means comprises an optical indicator.

24. The detection system according to claim 21 wherein the detection indication means includes means for transmitting a detection indication signal to an external elevator safety system.

* * * * *